US009539464B1

(12) United States Patent
Liu et al.

(10) Patent No.: US 9,539,464 B1
(45) Date of Patent: Jan. 10, 2017

(54) EXERCISE DEVICE

(71) Applicant: Dyaco International Inc., Taipei (TW)

(72) Inventors: Shih-Wei Liu, Taipei (TW); Hsuan-Fu Huang, Taipei (TW)

(73) Assignee: Dyaco International Inc., Taipei (TW)

( * ) Notice: Subject to any disclaimer, the term of this patent is extended or adjusted under 35 U.S.C. 154(b) by 6 days.

(21) Appl. No.: 14/850,203

(22) Filed: Sep. 10, 2015

(51) Int. Cl.
*A63B 22/04* (2006.01)

(52) U.S. Cl.
CPC ..... *A63B 22/04* (2013.01)

(58) Field of Classification Search
CPC ..... A63B 22/0664; A63B 22/001; A63B 22/0015; A63B 21/225; A63B 2022/0682; A63B 2022/067; A63B 2022/0676; A63B 22/0056; A63B 21/012; A63B 2225/09; A63B 22/0023; A63B 21/4035; A63B 21/4034; A63B 23/03591; A63B 22/0046; A63B 2210/50; A63B 22/203; A63B 22/205; A63B 22/00; A63B 22/04; A63B 22/08; A63B 22/10; A63B 22/12
USPC ..... 482/52
See application file for complete search history.

(56) References Cited

U.S. PATENT DOCUMENTS 6,004,244 A * 12/1999 Simonson ..... A63B 21/153 482/51
7,594,877 B2 * 9/2009 Anderson ..... A63B 21/154 482/51
7,713,176 B1 * 5/2010 Farney ..... A63B 21/154 482/52
8,979,713 B2 * 3/2015 Huang ..... A63B 22/04 482/51
2008/0139366 A1 * 6/2008 Born ..... A63B 22/0664 482/52
2008/0261780 A1 * 10/2008 Giannelli ..... A63B 22/001 482/52
2009/0062080 A1 * 3/2009 Guy ..... A63B 22/001 482/52
2009/0209394 A1 * 8/2009 Kwon ..... A63B 22/001 482/52
2010/0137111 A1 * 6/2010 Van Handel ..... A63B 22/001 482/52
2010/0167880 A1 * 7/2010 Long ..... A63B 22/001 482/52
2010/0216606 A1 * 8/2010 Liao ..... A63B 22/001 482/52
2012/0077645 A1 * 3/2012 Lee ..... A63B 22/001 482/52

(Continued)

*Primary Examiner* — Andrew S Lo
(74) *Attorney, Agent, or Firm* — Donald E. Stout; Stout, Uxa & Buyan, LLP

(57) ABSTRACT

An exercise device comprises a frame, two first swing arms, two second swing arms, two pedals, a resistance device, two cranks, two link rods, a lever bracket, two rock rods, and an adjusting device. Each first swing arm has a first end coupling with the frame and a second end coupling with a first end of one second swing arm, which has a second end coupling with one pedal. Each crank has a first end coupling with the resistance device and a second end coupling with a first end of one link rod, which has a second end coupling with one second swing arm. The lever bracket pivotally couples with the frame and has two fulcrums. Each rock rod has a first end coupling with one fulcrum and a second end coupling with one second swing arm. The adjusting device adjusts the distance between the fulcrums and an axle.

7 Claims, 6 Drawing Sheets

(56) References Cited

U.S. PATENT DOCUMENTS

| | | | | |
|---|---|---|---|---|
| 2014/0051552 | A1* | 2/2014 | Habing | A63B 21/154 482/52 |
| 2014/0080675 | A1* | 3/2014 | Anderson | A63B 71/0622 482/52 |
| 2014/0221166 | A1* | 8/2014 | Huang | A63B 22/001 482/52 |
| 2014/0274575 | A1* | 9/2014 | Yim | A63B 23/03516 482/52 |
| 2015/0238807 | A1* | 8/2015 | Long | A63B 23/03533 482/52 |

* cited by examiner

EXERCISE DEVICE

BACKGROUND OF THE INVENTION

1. Field of the Invention

The present invention relates to an exercise device, and more particularly relates to an exercise device providing ergonomic paths and variable stride lengths.

2. Description of Related Art

Without limiting the disclosed embodiments, a stair stepper, is an exercise device to elevate the heart rate, burn calories and improve cardiovascular endurance.

On a typical stair stepper, a user stands on two platforms supported by a given level of resistance. The user lifts alternating feet, as if walking up a set of stairs, so as to build muscle in legs and gluteus. The stair stepper is also a lower-impact training machine compared to a treadmill, making it useful for those with leg injuries. However, the stair stepper should be used with caution because inadequately activating will place additional stress on the knees.

FIG. 1A and FIG. 1B show two conventional stair steppers. FIG. 1A shows a convention stair stepper with an axis 21 and a pedal 20 coupling with the axis 21 via a rod 22, so that the pedal 20 moves along a path P. FIG. 1B shows another conventional stair stepper with two axis 21 and a pedal 20 coupling with the two axis 21 via two rods 22, so that the pedal 20 moves along a path P. Noticed that the both paths P are an arc with a center pointing away the user, and the paths P are not ergonomic and thus cannot simulate the real stepping, striding, or stair-climbing.

US patent US20120077645 discloses a stair stepper, in which the crank arm exerts force to the linking units, so that the pedal link coupled with the linking units can be moved forward and backward. Each pedal link has a rollable anti-friction member to pivotally couple with the pedal. When the pedal link is moved forward, the rollable anti-friction member drags the pedal climbing forwardly and upwardly along the ramp rod. However, the climbing force of the pedals is unsufficient, and thus the design is not a good solution to simulate stepping, striding, or stair-climbing.

In addition, conventional steppers cannot adjust stride length for variant users.

Moreover, each pedal of conventional steppers is moved along a track or rod, and thus noise may be produced during the movement of the pedal.

The detail of conventional steppers can also refer to Taiwan patent 1458519, entitled "adjustable stepper," and Taiwan patent 1442955, entitled "stepper," the entire contents of the foregoing applications are incorporated herein for reference.

SUMMARY OF THE INVENTION

In one general aspect, the present invention relates to an exercise device having ergonomic paths and variable stride lengths.

In an embodiment of the present invention, an exercise device is provided with a frame, two first swing arms, two second swing arms, two pedals, a resistance device, two cranks, two link rods, a lever bracket, and an adjusting device. The two first swing arms are respectively arranged at a left side and a right side of the frame, and each first swing arm has a first end pivotally coupling with the frame. The two second swing arms couple with the two first swing arms. Each first swing arm has a second end pivotally coupling with a first end of one corresponded second swing arm. The two pedals couple with the two second swing arms. Each second swing arm has a second end coupling with one corresponded pedal. The resistance device has an axle pivoted to the frame for providing a resistance. The two cranks are respectively arranged at a left side and a right side of the resistance device, with each crank having a first end coupling with the axle of the resistance device. The two link rods couple with the two cranks and the two second swing arms. Each link rod has a first end and a second end. The first end of each link rod pivotally couples with a second end of one corresponded crank, and the second end of each link rod pivotally couples with a portion of one corresponded second swing arm. The lever bracket has two fulcrums and pivotally couples with the frame via two first pivots. The two rock rods couples with the lever bracket and the two second swing arms. Each rock rod has a first end pivotally coupling with one corresponded fulcrum and a second end pivotally coupling with a portion one corresponded second swing arm. The adjusting device is arranged between the frame and the lever bracket and movably couples with the lever bracket, so as to adjust a distance between the axle of the resistance device and the two fulcrums of the lever bracket.

In an embodiment, each rock rod swings back and forth on the corresponded fulcrum of the lever bracket, so as to bring the corresponded pedal coupled by the corresponded second swing arm moving along a reciprocal moving path.

In an embodiment, the frame comprises a base and a supporting structure, the base is arranged on a supporting plane or ground, the supporting structure is arranged on the base, and the two first pivots of the lever bracket pivotally couple with the base.

In an embodiment, the adjusting device comprises a motor, a screw, and a tube, the tube has internally thread to engage with the screw, and the motor is used to drive the screw to rotate, so that the tube is moved along the screw in a direction toward the motor or away from the motor.

In an embodiment, the adjust device movably couples the lever bracket via a linkage, in which the tube of the adjusting device couples with a portion of the linkage, a first end of the linkage pivotally couples with a second pivot of the lever bracket, and a second end of the linkage pivotally couples with a pivot of the supporting structure of the frame.

In an embodiment, when the motor drives the screw to rotate so as to move the tube along the screw in a direction toward the motor, a distance between the axle of the resistance device and the two fulcrums of the lever bracket is decreased, a stride length between two pedals is decreased, and an angle between the reciprocal moving path and a horizontal direction is decreased.

In an embodiment, when the motor drives the screw to rotate so as to move the tube along the screw in a direction away from the motor, a distance between the axle of the resistance device and the two fulcrums of the lever bracket is increased, a stride length between two pedals is increased, and an angle between the reciprocal moving path and a horizontal direction is increased.

In an embodiment, the lever bracket has a bended U-shaped configuration.

In an embodiment, each pedal has an inclination, and the inclination of the pedal at the lowest position is smaller the inclination of the pedal at the highest position.

DETAILED DESCRIPTION OF THE PREFERRED EMBODIMENT

Figure 1A:
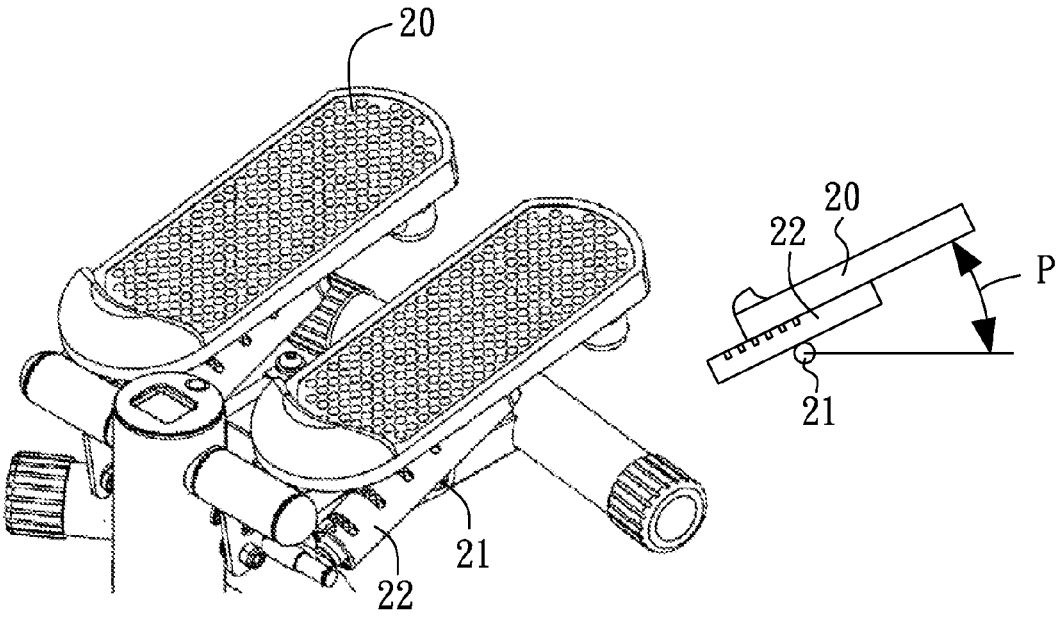
FIG.1A(PRIOR ART)
FIGS. 1A and 1B show two conventional stair steppers and their moving tracks.
Figure 1B:
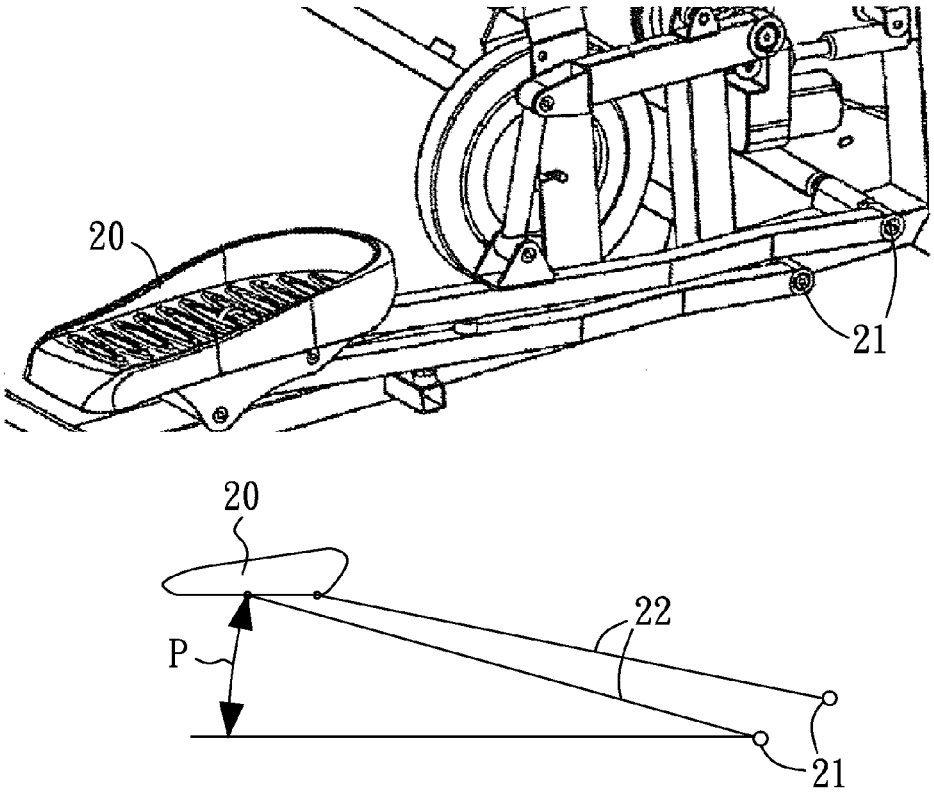
FIG.1B(PRIOR ART)

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
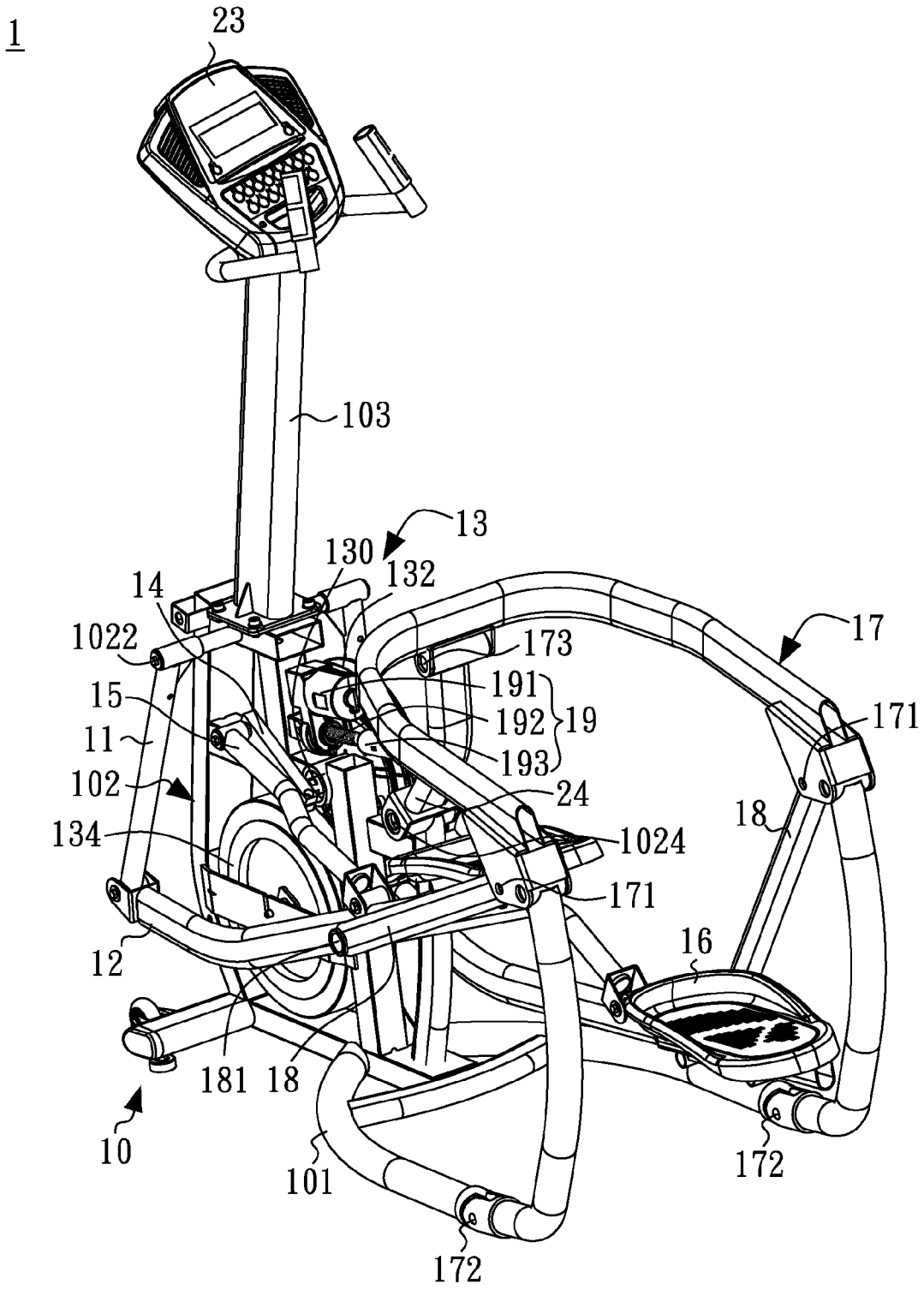
FIG. 2 is a perspective view showing an exercise device according to a preferred embodiment of the present invention.
Figure 3:
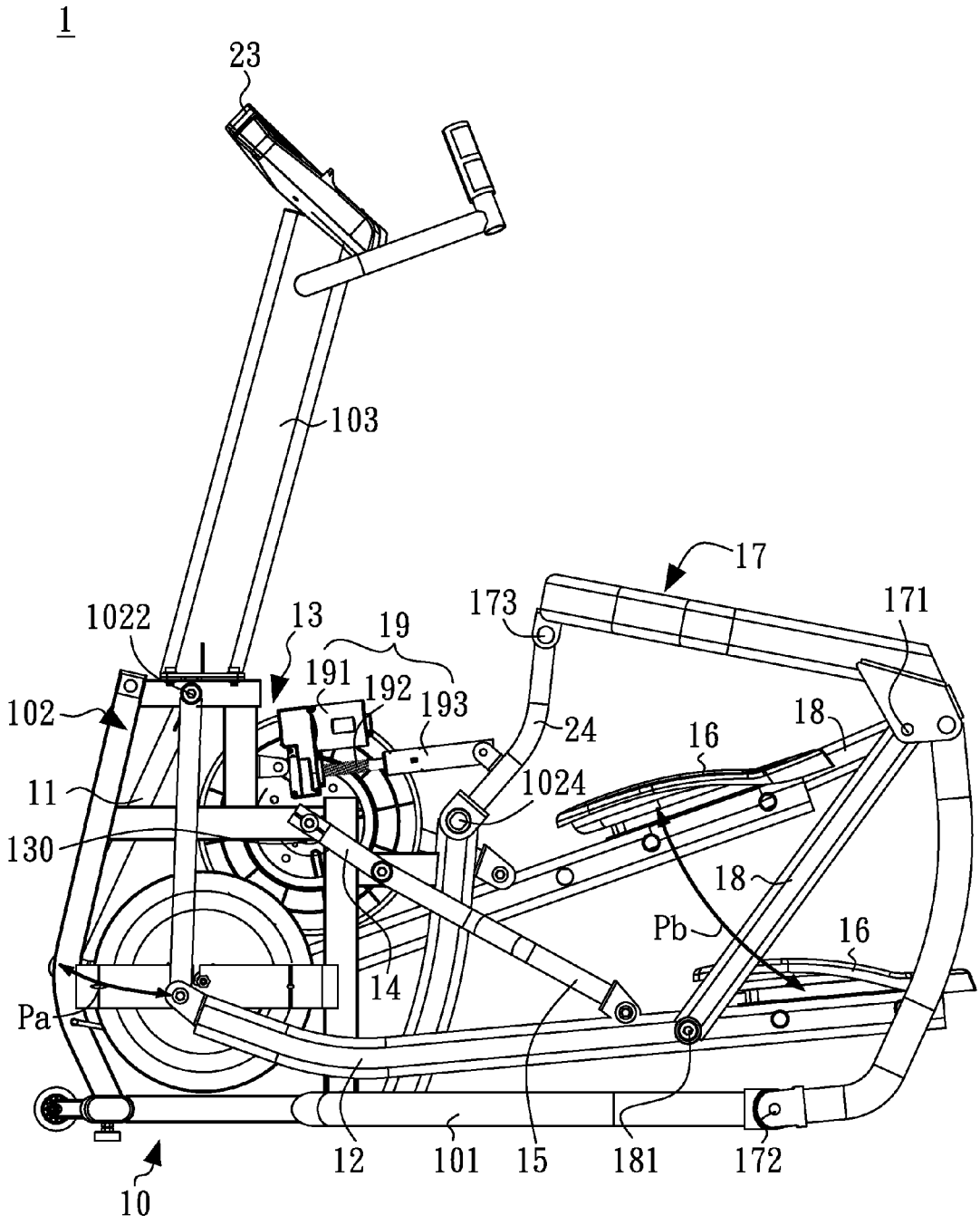
FIG. 3 is a side view showing the operation of the exercise device of FIG. 2.
Figure 4:
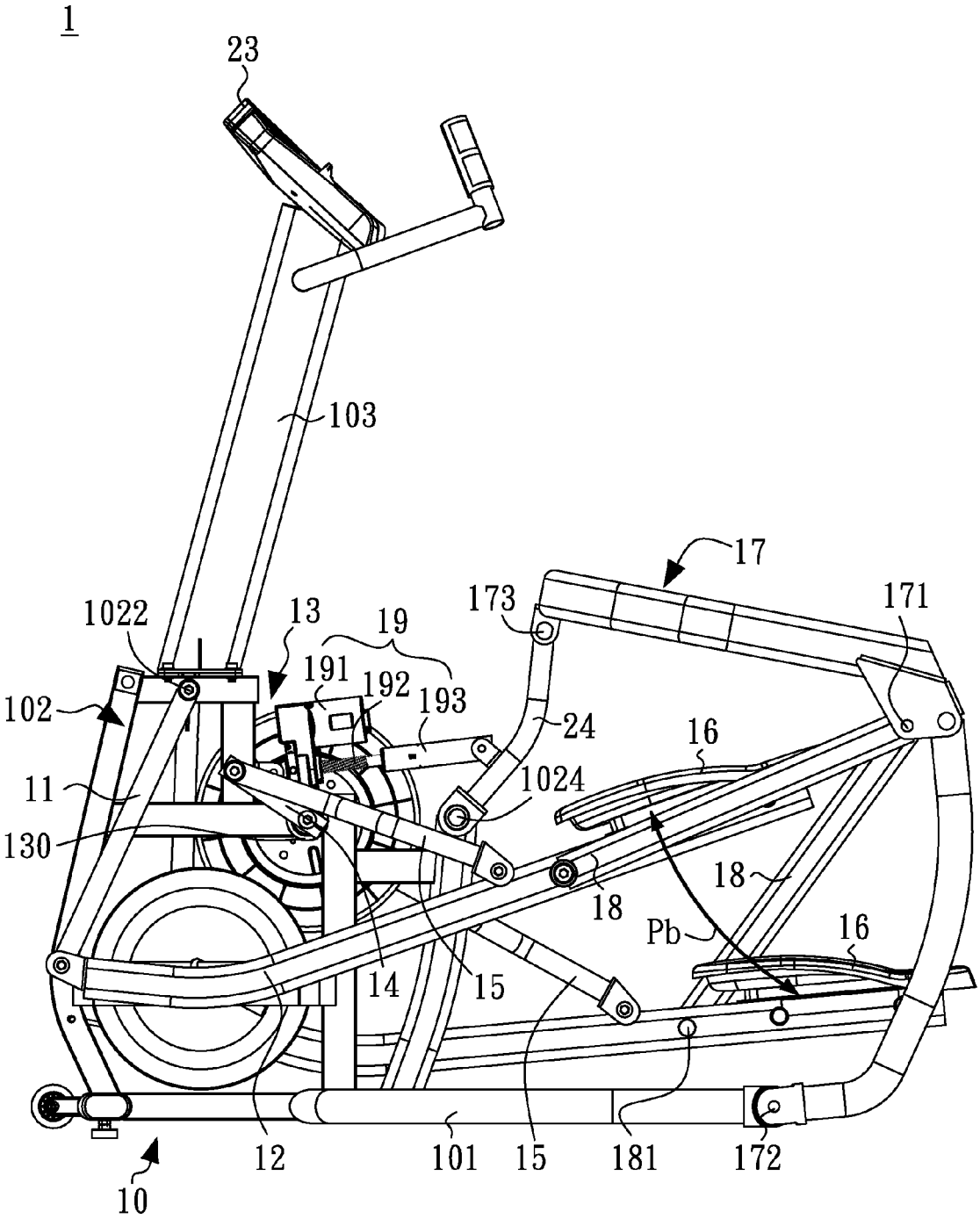
FIG. 4 is a side view showing the operation of the exercise device of FIG. 2.

FIGS. 2, 3, and 4 are perspective and side perspective views, respectively, showing an exercise device 1 according to a preferred embodiment of the present invention. The exercise device 1 comprises a frame 10, two first swing arms 11, two second swing arms 12, a resistance device 13, two cranks 14, two link rods 15, two pedals 16, a lever bracket 17, two rock rods 18, and an adjusting device 19.

Referring to FIGS. 2, 3, and 4, preferably the frame 10 comprises, but is not limited to, a base 101 and a supporting structure 102. The base 101 is placed on a supporting plane or ground. The supporting structure 102 is arranged on the base 101. In this preferred embodiment, a post 103 may be arranged on the supporting structure 102, in which one end of the post 103 couples with the supporting structure 102, and the other end of the post 103 couples with an operating interface 23 allowing the user to control the exercise device 1.

Referring to FIGS. 2, 3, and 4, the two first swing arms 11 are respectively arranged at a left side and a right side of the frame 10, and each first swing arm 11 has a first end pivotally coupling with the frame 10 by a pivot 1022. The two second swing arms 12 couples with the two first swing arms 11, and each first swing arm 11 has a second end pivotally coupling with a first end of one corresponded second swing arm 12. The two pedal 16 couples with the two second swing arms 12. Each second swing arm 12 has a second end coupling with one corresponded pedal 16.

Referring to FIGS. 2, 3, and 4, the resistance device 13 is used for providing a resistance and pivots to the frame 10 by an axle 130. The two cranks 14 are respectively arranged at a left side and a right side of the resistance device 13, and each crank 14 has a first end coupling with the axle 130 of the resistance device 13. The two link rods 15 couple with the two cranks 14 and the two second swing arms 12. In detail, each link rod 15 has a first end and a second end, in which the first end of each link rod 15 pivotally couples with a second end of one corresponded crank 14, and the second end of each link rod 15 pivotally couples with a portion of one corresponded second swing arm 12. Accordingly, the first swing arm 11, the crank 14, and the link rod 15 will drag the second swing arm 12 moving along a reciprocal moving path Pa.

Referring to FIGS. 2, 3, and 4, when a user stands on two pedals 17, a resistance is given by the resistance device 13. The operating interface 23 mounted above the frame 10 can determine the resistance. In this preferred embodiment, the resistance device 13 may comprise, but is not limited to, a driving wheel 132 and a flywheel 134. The driving wheel 132 has the axle 130 with bidirectional bearing (not shown) coupling with the first end of the two cranks 14. The motion of the pedals 17 will drive the driving wheel 132, which then drives the flywheel 134 to rotate.

Referring to FIGS. 2, 3, and 4, preferably the lever bracket 17 has a bended U-shaped configuration. The lever bracket 17 includes two fulcrums 171 arranged at the middle portion of the lever bracket 17 and includes two first pivots 172 arranged at the left lower end and the right lower end of the lever bracket 17, respectively. The lever bracket 17 pivotally couples with the frame 10, e.g., coupling with the base 101 of the frame 10, via the two first pivots 172. In addition, the two rock rods 18 couple with the lever bracket 17 and the two second swing arms 12. In detail, each rock rod 18 includes a first end pivotally coupling with one corresponded fulcrum 171 of the lever bracket 17, and includes a second end pivotally coupling with a portion of one corresponded second swing arm 12 via a pivot 181. The adjusting device 19 is arranged between the frame 10 and the lever bracket 17 and movably couples with the level bracket 17, so as to adjust the distance between the axle 130 of the resistance device 13 and the fulcrum 171 of the lever bracket 17. The detail is described as follows.

Referring to FIGS. 2, 3, and 4, each rock rod 18 swings back and forth on one corresponded fulcrum 171 of the lever bracket 17, so as to bring the corresponded pedal 16 coupled by the corresponded second swing arm 12 moving along a reciprocal moving path Pb. In addition, when the pedal 17 is moved to the lowest position, the rear portion of the pedal 17 will be lifted a bit or the whole pedal 17 is near horizontal. When the pedal 17 is moved to the highest position, the rear portion of the pedal 17 will be lifted considerably. That is, the inclination of the pedal 17 at the lowest position is smaller the inclination of the pedal 17 at the highest position. The variable inclination and smooth path Pb are quite ergonomic for simulating stepping, striding, or stair-climbing, and therefore the user can operate the exercise devise 1 easily and safely.

Referring to FIGS. 2, 3, and 4, the adjusting device 19 may comprise, but is not limited to, a motor 191, a screw 192, and a tube 193. The tube 193 has internally thread to engage with the screw 192, and the motor 191 is used to drive the screw 192 to rotate, so that the tube 193 is moved along the screw 192 in a direction toward the motor 191 or away from the motor 191.

Referring to FIGS. 2, 3, and 4, in this preferred embodiment, the adjusting device 19 movably couples with the lever bracket 17 via a linkage 24. In detail, the tube 193 movably couples with a portion of the linkage 24, a first end of the linkage 24 pivotally couples with a second pivot 173 of the lever bracket 17, and a second end of the linkage 24 pivotally couples with a pivot 1024 of the supporting structure 102 of the frame 10.

Figure 5:
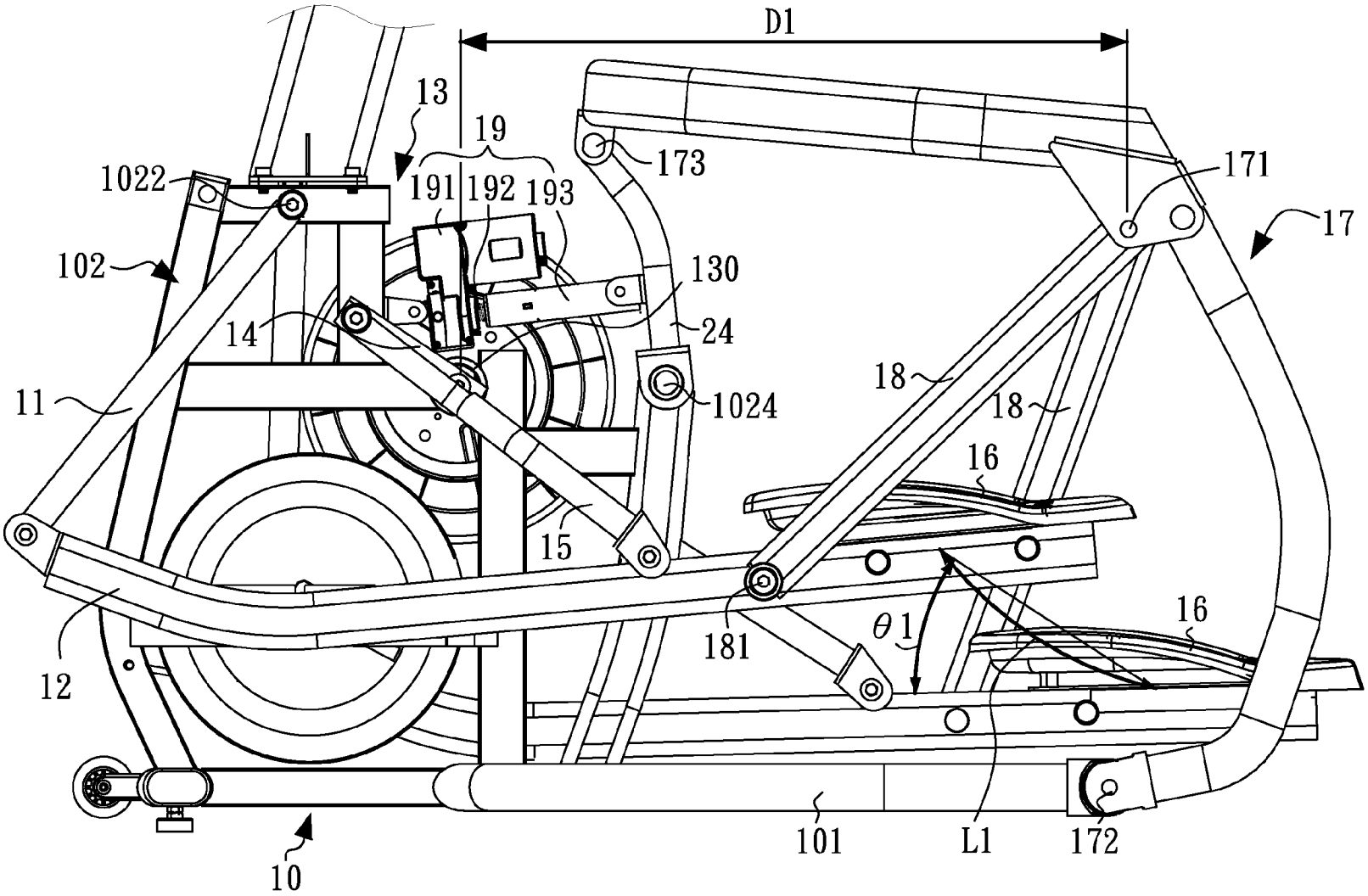
FIG. 5 is a partially side view showing the operation of the exercise device of FIG. 2.

FIG. 5 is a partially side view showing the operation of the exercise device 1. Referring to FIG. 5, when the motor 191 drives the screw 192 to rotate so as to move tube 193 along the screw 192 in a direction toward the motor 1, the distance between the axle 130 of the resistance device 13 and the fulcrum 171 is decreased to D1 (minimum), the stride length between two pedals 16 is decreased to L1 (minimum) and the angle between the reciprocal moving path L1 and a horizontal direction is decreased to θ1 (minimum, about 22°, for example).

Figure 6:
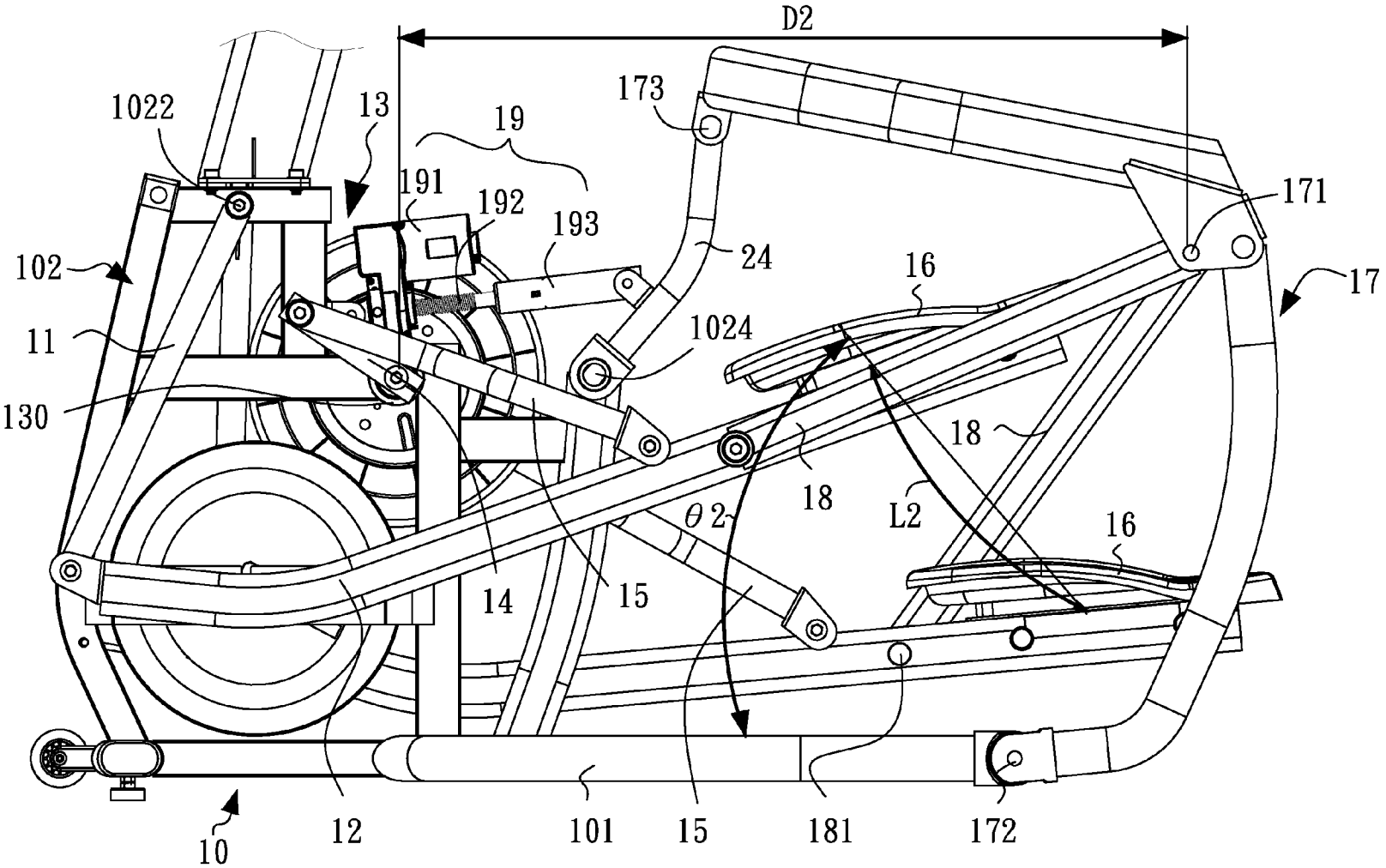
FIG. 6 is a partially side view showing the operation of the exercise device of FIG. 2.

FIG. 6 is a partially side view showing the operation of the exercise device 1. Referring to FIG. 6, when the motor 191 drives the screw 192 to rotate so as to move tube 193 along the screw 192 in a direction away from the motor 1, the distance between the axle 130 of the resistance device 13 and the fulcrum 171 is increased to D2 (maximum), the stride length between two pedals 16 is increased to L2 (maximum) and the angle between the reciprocal moving path L2 and a horizontal direction is increased to θ2 (maximum, about 55°, for example).

The user may adjust the stride length between the stride length L1 and L2 via the adjusting device 19, which is controlled by the operating interface 23. And a suitable stride length may be obtained by adjusting the distance between the axle 130 of the resistance device 13 and the fulcrum 171 of the lever bracket 17.

Accordingly, the present invention provides an exercise device having the following advantages. Compared with the conventional non-ergonomic moving path, the moving path Pb of the present invention is an arc with a center pointing at the legs or feet of the user and therefore is ergonomic. In addition, because the cranks 14 directly exert force to the second swing arms 12, the climbing force given to the pedals 16 will be sufficient and strong. With the strong climbing force and ergonomic moving path Pb, the stepping, striding, or stair-climbing exercises can be realistically simulated. Furthermore, the moving path Pb is smooth and the user will feel unhindered when operating the exercise device 1.

In addition, the present invention provides an exercise device 1 that an angle between the moving path Pb of the pedal 16 and a horizontal direction can be adjusted. For example, the angle can be adjusted between 22° and 55°, so as to change the height of the lifting legs and thus different training effects are achieved.

Furthermore, each pedal 16 is not moved along a limiting rod or track, and therefore the pedals 16 will not produce noise during the movement.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a frame;

two first swing arms respectively arranged at a left side and a right side of the frame, each first swing arm having a first end pivotally coupling with the frame;

two second swing arms coupling with the two first swing arms, each first swing arm having a second end pivotally coupling with a first end of one corresponded second swing arm;

two pedals coupling with the two second swing arms, each second swing arm having a second end coupling with one corresponded pedal;

a resistance device having an axle pivoted to the frame for providing a resistance;

two cranks respectively arranged at a left side and a right side of the resistance device, each crank having a first end coupling with the axle of the resistance device;

two link rods coupling with the two cranks and the two second swing arms, each link rod having a first end and a second end, the first end of each link rod pivotally coupling with a second end of one corresponded crank, the second end of each link rod pivotally coupling with a portion of one corresponded second swing arm;

a lever bracket having two fulcrums and pivotally coupling with the frame via two first pivots;

two rock rods coupling with the lever bracket and the two second swing arms, each rock rod having a first end pivotally coupling with one corresponded fulcrum and a second end pivotally coupling with a portion of one corresponded second swing arm; and an adjusting device being arranged between the frame and the lever bracket and movably coupling with the lever bracket, so as to adjust a distance between the axle of the resistance device and the two fulcrums of the lever bracket, wherein the adjusting device comprises a motor, a screw, and a tube, the tube is internally thread to engage with the screw, and the motor is used to drive the screw to rotate, so that the tube is moved along the screw in a direction toward the motor or away from the motor, and wherein the adjusting device movably couples to the lever bracket via a linkage, in which the tube of the adjusting device couples with a portion of the linkage, a first end of the linkage pivotally couples with a second pivot of the lever bracket, and a second end of the linkage pivotally couples with a pivot of a supporting structure of the frame.

2. The exercise device of claim 1, wherein each rock rod swings back and forth on the corresponded fulcrum of the lever bracket, so as to bring the corresponded pedal coupled by the corresponded second swing arm to move along a reciprocal moving path.

3. The exercise device of claim 1, wherein the frame comprises a base and the supporting structure, the base is arranged on a supporting plane or ground, the supporting structure is arranged on the base, and the two first pivots of the lever bracket pivotally couple with the base.

4. The exercise device of claim 1, wherein when the motor drives the screw to rotate so as to move the tube along the screw in a direction toward the motor, a distance between the axle of the resistance device and the two fulcrums of the lever bracket is decreased, a stride length between two pedals is decreased, and an angle between a reciprocal moving path and a horizontal direction is decreased.

5. The exercise device of claim 1, wherein when the motor drives the screw to rotate so as to move the tube along the screw in a direction away from the motor, a distance between the axle of the resistance device and the two fulcrums of the lever bracket is increased, a stride length between two pedals is increased, and an angle between a reciprocal moving path and a horizontal direction is increased.

6. The exercise device of claim 1, wherein the lever bracket has a bended U-shaped configuration.

7. The exercise device of claim 1, wherein each pedal has an inclination, and the inclination of the pedal at a lowest position is smaller the inclination of the pedal at a highest position.

* * * * *